US005439135A

United States Patent [19]

Schrader et al.

[11] Patent Number: 5,439,135

[45] Date of Patent: Aug. 8, 1995

[54] GOLF TEE DISPENSING DEVICE

[75] Inventors: V. E. Schrader; Davis W. Simpson, both of San Antonio, Tex.

[73] Assignee: Nifty-Lift, Inc., San Antonio, Tex.

[21] Appl. No.: 193,956

[22] Filed: Feb. 9, 1994

[51] Int. Cl.[6] ..... B65G 59/00

[52] U.S. Cl. ..... 221/251; 221/289

[58] Field of Search ..... 221/232, 231, 199, 194, 221/289, 251, 295

[56] References Cited

U.S. PATENT DOCUMENTS

| | | | |
|---|---|---|---|
| 2,260,643 | 10/1941 | Rosan | 221/295 |
| 3,252,615 | 5/1966 | Hill et al. | 221/82 |
| 3,800,981 | 4/1974 | Zeller | 221/198 |
| 3,840,149 | 10/1974 | Zeller | 221/199 |
| 3,891,130 | 6/1975 | Brennan | 224/5 |
| 3,902,634 | 9/1975 | Bromley et al. | 221/310 |
| 3,984,029 | 10/1976 | Baugh | 221/2 |
| 4,289,254 | 9/1981 | Spring | 221/295 |
| 4,573,610 | 3/1986 | Hurner | 221/281 |
| 4,781,307 | 11/1988 | Ferro | 221/131 |
| 4,858,784 | 8/1989 | Moody | 221/155 |
| 4,889,260 | 12/1989 | Zeller | 221/197 |
| 5,040,675 | 8/1991 | Cleveland et al. | 206/315.9 |

*Primary Examiner*—Kenneth W. Noland

*Attorney, Agent, or Firm*—Gunn, Lee & Miller

[57] ABSTRACT

A golf tee dispensing device capable of individually releasing one of a number of standard sized golf tees from a plurality of tees stored and retained within the dispensing device. The device includes a tube for the ordered retention of the golf tees and a means for forcing the golf tees upward to an open end of the tube for release. The dispensing device incorporates a pivoting mechanism on the open end of the dispensing tube that is structured so as to singularly release a golf tee from the dispensing device and simultaneously preventing the release of a subsequent golf tee next in line within the tube. A spring within the tube forces the golf tees up through the dispensing tube and appropriately positioned stop tabs on the dispensing mechanism prevent and control the release of the golf tees one at a time from the device.

4 Claims, 3 Drawing Sheets

GOLF TEE DISPENSING DEVICE

BACKGROUND OF THE INVENTION

1. Field of the Invention

The present invention relates generally to devices and accessories for the play of the game of golf especially as it utilizes golf ball tees. The present invention relates more specifically to a golf ball tee dispenser designed to contain and individually dispense golf tees to the golfer.

2. Description of the Prior Art

Among the three or four essential items utilized in the play of the game of golf are golf clubs, golf balls, and golf ball tees. Beyond these items and a golf course on which play may occur, little more is needed. Typically, a golfer has a single set of clubs that are easily retained in a golf bag and/or are carried by the golfer. Typically one or a few golf balls are utilized in the play of the game and are not carried but rather remain on the course during play. Generally the goal of the play of golf is to utilize but one golf ball and to maintain its whereabouts on the course of play.

Golf tees on the other hand are more disposable items and in a single 18 hole round of golf a player might go through as many as one per hole of play. It is frequently necessary, therefore, to have a large supply of golf ball tees available to the golfer during a round of golf.

Unfortunately the configuration of golf tees is such that they are difficult to store in a manner that provides, ready availability and individual dispensing. Golf tees by their nature are pointed on one end for insertion into the ground and, therefore, do not lend themselves to be easily and comfortably stored on the golfer's person. Nonetheless, golf tees are frequently retained in the golfer's pocket, placed in special loops in the golfer's cap, or at times placed in similar loops attached to other golfing implements such as golf carts, golf bags, golf shoes, etc. Some means for dispensing golf ball tees that would make them readily available to the golfer as they are needed but would not otherwise be in the way during golf play, is desirable.

A number of golf tee dispensers have been developed in the past and many provide an efficient means for dispensing single golf tees to the golfer. U.S. Pat. No. 4,858,784 issued to Moody entitled "Golf Tee Dispenser" describes a number of prior art configurations for golf tee dispensers and distinguishes its own invention from the prior art by way of the means for retaining individual golf tees. There are also a number of more complex golf tee dispensers that have been disclosed including U.S. Pat. Nos. 3,800,981 issued to Zeller, 3,252,615 issued to Hill et al., 3,840,149 issued to Zeller, 3,984,029 issued to Baugh, 4,573,610 issued to Hurner, and 4,781,307 issued to Ferro. Of the above issued U.S. Pat. Nos., Baugh '029 and Ferro '307 incorporate golf tee dispensing devices in conjunction with golf ball dispensing devices. Finally, U.S. Pat. No. 3,902,634 issued to Bromley et al. entitled "Golf Tee Magazine" discloses a means for retaining and dispensing golf tees that can be incorporated into a golf bag.

Most of the devices described in these prior patents utilize a dispensing means that relies upon the gravity feed of the golf tee in a downward direction either within a magazine or cartridge tube structure, and the semi-stable retention of the bottom tee in the tube at the opening of the tube by way of some type of moveable obstruction.

The movable obstruction holding the golf tee to be dispensed in many cases has simply been a flexible band or a flexible cap with an aperture that may be temporarily stretched or deformed to remove a single tee, but which thereafter retains a closed shape blocking the next tee from falling through the tube. A few designs, such as Bromley, incorporate spring loaded magazines that allow the tees to be dispensed upward and to thereby allow the device to be mounted within a golf club bag in a manner that still allows access to the dispensing tees. This orientation, however, does require the use of a spring within the magazine that forces the golf tees upward against the force of gravity. This arrangement, however, also requires some mechanism for maintaining the first golf tee available to be dispensed and preventing subsequent golf tees from immediately following thereafter. The Bromley patent described above utilizes a flexible array of brushes whose friction and resilient force are sufficient to retain a golf tee against the force of the spring. Unfortunately, this means that the golf tee must protrude significantly from the dispensing device and is further subject in changes to the force of the spring as a result of more or less tees having been dispensed from the container. In other words, the force of the spring when but one or two tees remain in the container is less than the force when the magazine is full. The ability of the retention device in the Bromley patent to adapt to these changes in spring force is limited.

Simply put, most of the prior art discloses golf tee dispensing devices that, though they retain and provide access to a number of golf tees in sequence, have significant problems with the mechanism for allowing a single golf tee to be dispensed at a time. Improvements in the field, therefore, would be best directed towards a more efficient, more reliable means for sequentially allowing a single tee to be dispensed to the golfer. The apparatus of the present invention seeks to provide such an improvement over the prior art in a golf tee dispensing device.

SUMMARY OF THE INVENTION

It is therefore an object of the present invention to provide a simple, inexpensive, yet durable golf tee dispensing magazine that can be conveniently mounted in a golf bag, on a golf cart, or on some other standard implement utilized in the play of a golf game.

It is a further object of the present invention to provide a tubular golf tee magazine that positions a number of golf tees with the pointed end of the next accessible golf tee directed away from the golfer accessing the tee.

It is another object of the present invention to provide a tubular golf tee magazine that incorporates a spring fed mechanism whereby a supply of golf tees may be directed upward through the dispensing tube end and individually retained in a manner that allows for single tee dispensing.

It is another object of the present invention to provide a tubular golf tee magazine having a retaining means at a dispensing end that allows not only the individual release of single golf tees when needed, but through which a resupply of golf tees can be loaded into the magazine.

It is another object of the present invention to provide a tubular golf tee magazine having a retaining means at its dispensing end that does not rely upon the structural resiliency of a material that might eventually wear out through use.

It is another object of the present invention to provide a tubular golf tee magazine that allows dispensing of individual golf tees without the need for the golfer to specifically withdraw a tee from the magazine, but rather automatically presents the golf tee to the golfer with little effort.

It is another object of the present invention to provide a tubular golf tee magazine having a retaining means at its dispensing end that simultaneously releases a first tee into the hand of the golfer and interrupts the flow of subsequent golf tees upward in the magazine to prevent the release of a second golf tee until needed.

These and other more specific objects of the present invention will be apparent upon a reading of the following specifications and the appended claims and upon considering in connection therewith the attached drawings to which they relate. Not only are alternative embodiments of the present invention made apparent by the specifications, but additional applications and uses of the fundamental design of the present invention will also become apparent.

DETAILED DESCRIPTION OF A PREFERRED EMBODIMENT

Figure 1:
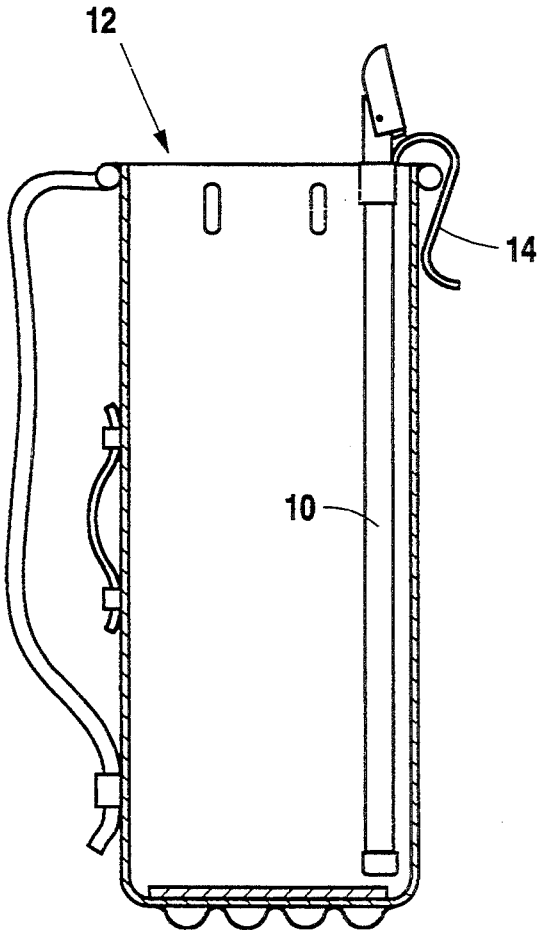
FIG. 1 is a partial cross sectional view showing a preferred embodiment of the present invention supported within the interior wall of a typical golf bag.

Reference is first made to FIG. 1 for a detailed description of the overall structure of preferred embodiment of the invention as it might be incorporated into a standard golf club bag. Golf tee dispenser (10) is structured and sized so as to be conveniently insertable into a standard sized golf club bag (12). Golf dispenser (10) is, therefore, of a length approximately equal to a standard golf club and of a diameter only slightly larger than a standard golf club, more on the order of the diameter of a golf club grip.

Golf tee dispenser (10) is insertable into golf bag (12) along an interior wall thereof and may be clipped across and around the top edge of golf club bag (12) by means of dispenser clip (14). This configuration allows dispenser (10) to be placed at any location within golf bag (12) or in fact allows dispenser (10) to be placed on the exterior of golf bag (12) with clip (14) directed inward in obvious fashion.

Dispenser (10) of the present invention could be utilized with any number of different clip configurations such that it might be retained on any golfing implement of significant size. Retention clips that would allow attachment of dispenser (10) to a golf cart, a golf bag holder, or any other golfing implement of sufficient length could be contemplated. The only important structural considerations involve the upwardly oriented dispensing means and the number of tees that could be contained within the tube and, therefore, the length of the tube.

Figure 2:
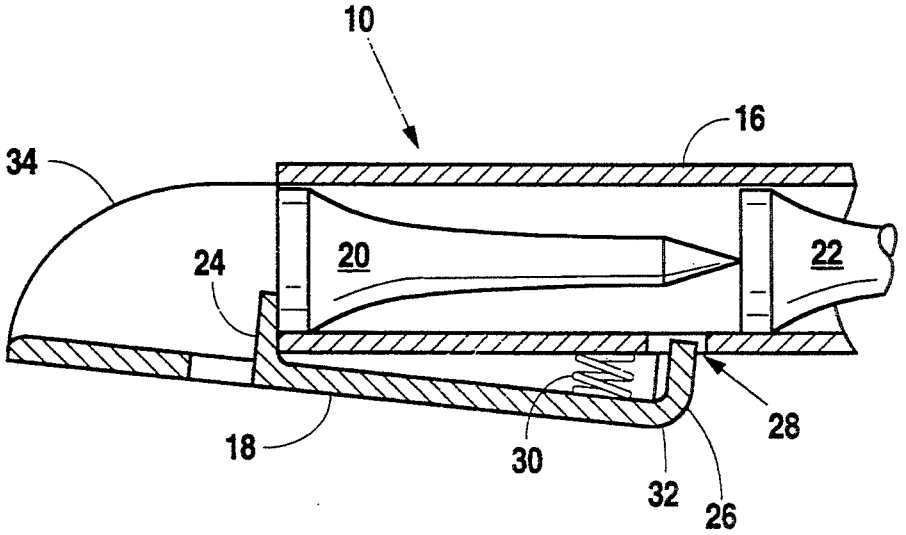
FIG. 2 is a partial cross sectional detailed view of the dispensing assembly of the preferred embodiment of the present invention.

Reference is now made to FIG. 2 for a detailed description of the primary improvement described in the preferred embodiment of the present invention. The dispensing end of golf tee dispenser (10) (here shown in cross section) incorporates an open end of golf tee tube (16). Tube (16) is sized and structured so as to retain the most commonly sized golf ball tees. These golf ball tees have average dimensions of 5–6 cm in length (pointed end to flat head end), and 11–12 mm in diameter at the flat head (golf ball retaining) end. The interior diameter of tube (16) should, therefore, be on the order of 12–14 cm in diameter. The exterior diameter of tube (16) is dependent more upon the structural rigidity desired in the dispensing tube (16) and not so much on any physical requirements defined by the golf tee. Schedule 40 PVC has been found to be of sufficiently rigid structure and appropriate wall thicknesses for the present invention.

Dispensing mechanism (18) is retained on an end of dispensing tube (16) by means of dimpled rotating impressions described in more detail below with respect to FIGS. 5 and 6. Dispensing mechanism (18) is pivotal on this mechanism described below in a manner that individually releases a first golf tee (20) from golf tee dispensing device (10) and then prevents a subsequent golf tee (22) from being immediately dispensed thereafter. Dispensing mechanism (18) comprises a semi-tubular cup that surrounds dispenser tube (16) on approximately ¾ of its exterior face. Primary stop tab (24) on dispensing means (18) is a portion of this tubular structure that is bent at right angles to the shell of dispensing means (18) in a manner that partially obstructs the opening of dispensing tube (16). This partial obstruction by tab (24) retains first golf tee (20) in position within dispensing tube (16). Secondary stop tab (26) is normally held out of position at an end of dispensing means (18) apart from the location of stop tab (24). Secondary stop tab (26) is also a tab bent at 90 degrees to the overall shell structure of dispensing means (18). Secondary stop tab (26) is positioned adjacent to and slightly within aperture (28) located in the wall of dispensing tube (16). When a tee is dispensed, secondary stop tab (26) is forced further into aperture (28) as described in more detail with regard to FIG. 7 below.

Dispensing means (18) is held in the position shown in FIG. 2 by means of rocker spring (30). The position of spring (30) forces dispensing mechanism (18) away from the side of dispensing tube (16) at the end where secondary stop tab (26) is located. This removes secondary stop tab (26) from aperture (28) and retains it there in a static configuration.

With spring (30) forcing distal end (32) of dispensing mechanism (18) away from dispensing tube (16) primary stop tab (24) is forced to a position partially obstructing the opening of dispensing tube (16). In this configuration, as indicated above, first golf tee (20) is prevented from being released from dispensing device (10). A spring (not shown) that is located within golf tee dispensing device (10) and described in more detail below with respect to FIG. 3, keeps golf tee (20) in a position adjacent to primary stop tab (24).

A proximal end (34) of dispensing mechanism (18) is structurally configured such that the golfer, upon desiring that a golf tee be dispensed, can make contact with proximal end (34) of dispensing mechanism (18) and force movement of the mechanism against spring (30) in a manner that allows the movement of primary stop tab (24) away from the opening of dispensing tube (16) and thereby allows for the release of first golf tee (20) from dispensing means (10). The function of dispensing mechanism (10) in this manner is described in more detail with respect to FIG. 7.

Figure 3:
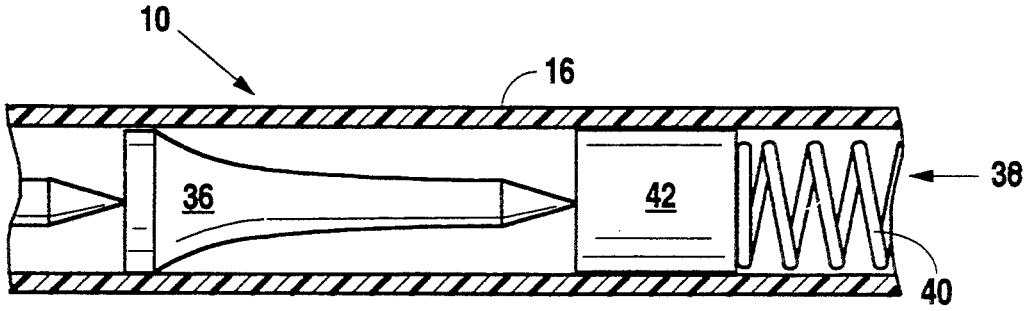
FIG. 3 is a partial cross sectional detailed view of a middle section of a preferred embodiment of the present invention showing the point at which the golf tees contained in the invention contact an interior spring.

Reference is now made to FIG. 3 for a detailed description of a mid section of the preferred embodiment of the present invention showing the contact between golf tees stored within the dispensing device and an internal spring that maintains the flow of golf tees upon removal. Again, the primary component of golf tee dispensing device (10) is dispensing tube (16) which at its central portion is shown in cross section with final golf tee (36) in the magazine, here disclosed adjacent to spring mechanism (38). Spring mechanism (38) is itself comprised of spring element (40) and spring block (42). Spring block (42) is intended to allow contact between spring mechanism (38) and a pointed end of golf tee (36). Absent the use of spring block (42), golf tee (36) would be insertable into the coiled structure of spring (40) and would likely cause jamming or fouling of the dispensing device. Spring block (42) in the preferred embodiment is permanently attached to an end of spring (40) in a manner that should the mechanism be disassembled the spring mechanism components would remain together.

Figure 4:
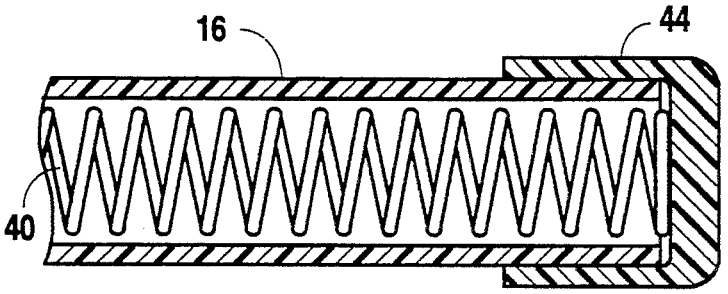
FIG. 4 is a cross sectional view of an end of the preferred embodiment of the present invention opposite the dispensing end shown in FIG. 2.

Reference is now made to FIG. 4 for a detailed description of an end of the dispensing device of the present invention opposite the dispensing end of the device. Opposite the end of dispensing tube (16) disclosed in FIG. 2 is a closed end of dispensing tube (16) shown in cross sectional in FIG. 4. In the preferred embodiment, this end of dispensing tube (16) is closed by means of cap (44). An end of spring element (40) opposite the end to which spring block (42) (shown in FIG. 3) is attached is shown as it butts against the inside face of cap (44).

Cap (44) may be permanently attached to the end of dispensing tube (16) in a manner that prevents the removal of spring element (40) other than through the open end of dispensing tube (16) shown in FIG. 2. In an alternative embodiment, cap (44) may be sized so as to fit snugly about dispensing tube (16), but to be removable under sufficient force for the purpose of clearing spring element (40) and any remaining golf tees (36) from dispensing tube (16).

Figure 5:
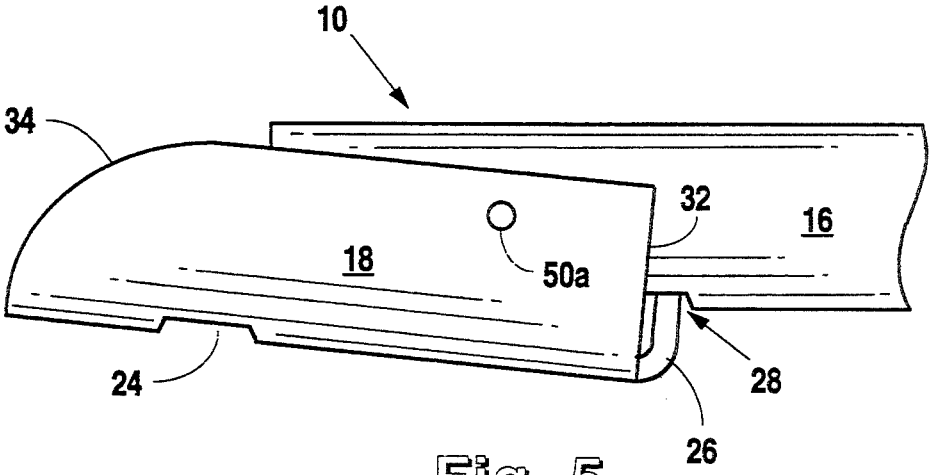
FIG. 5 is a partial side view of the dispensing end of a preferred embodiment of the present invention.

Reference is now made to FIG. 5 for a detailed description of a side view of the same end of golf tee dispensing device (10) as is shown in FIG. 2. FIG. 5 discloses the dispensing end of dispensing device (10) with dispensing mechanism (18) shown attached to and partially covering the open end of dispensing tube (16). Dispensing mechanism (18) is shown in FIG. 5 in its closed position as in FIG. 2, preventing the next golf tee (not shown) in line from being dispensed. Dispensing mechanism (18) is held in this position by spring (30) not seen since it is concealed by dispensing mechanism (18) in this view. Otherwise, dispensing mechanism (18) is pivotly attached to dispensing tube (16) by means of pivot indentations (50*a*) and (50*b*) shown on one side in FIG. 5 and with a mirror image disposed on an opposite side of dispensing mechanism (18) and dispensing tube (16). Pivot indentations (50*a*) and (50*b*) create minor projections (shown better in FIG. 6 below) that extend into similarly configured indentations in the walls of dispensing tube (16) at an appropriate location on each side thereof. In this manner, dispensing mechanism (18) is free to pivot about an axis drawn between pivot indentations (50*a*) and (50*b*) and, as such, to release a golf tee in line (not shown in FIG. 5) when appropriately moved by the user.

The pivoting of dispensing mechanism (18) is accomplished by way of the user placing his or her hand against the proximal end (34) of dispensing mechanism (18) in a manner that directs distal end (32) of dispensing mechanism (18) closer to dispensing tube (16). In this manner, the pivoting of dispensing mechanism (18) directs secondary stop tab (26) into aperture (28) to function with the release of the next golf tee (not shown) in a manner described in more detail below. The shape of proximal end (34) of dispensing mechanism (18) is such that it provides a comfortable means for contacting the hand of the user and pivoting dispensing mechanism (18) as described.

Figure 6:
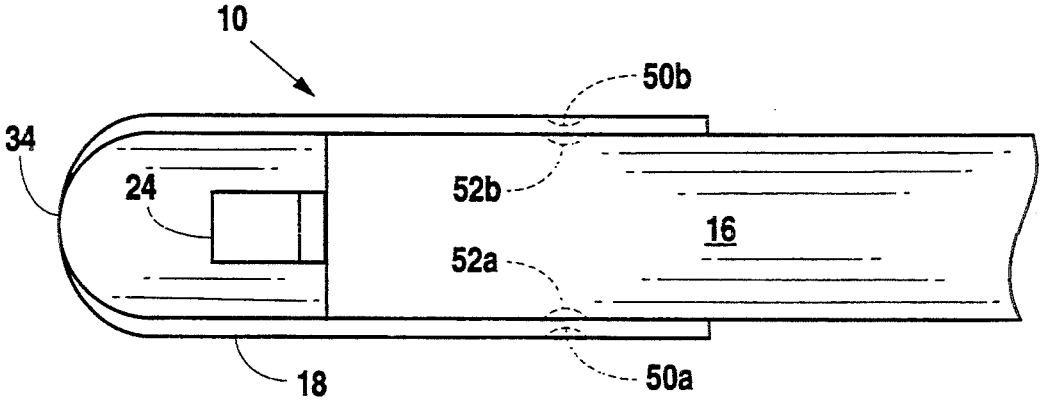
FIG. 6 is a partial top view of the dispensing end of a preferred embodiment of the present invention.

Reference is now made to FIG. 6 for a detailed description of a top view of the dispensing mechanism end of dispensing device (10). FIG. 6 again shows the position of dispensing mechanism (18) as it partially encloses the open end of dispensing tube (16). FIG. 6 provides a better view of the means whereby pivot indentations (50*a*) and (50*b*) project into similar indentations (52*a*) and (52*b*) in dispensing tube (16). Also seen more clearly in FIG. 6 is the position of primary stop tab (24) that, until moved away from the opening of dispensing tube (16), serves to prevent the release of the next golf tee (not shown) in line. In this view, proximal end (34) of dispensing mechanism (18) would be forced away from the viewer in a manner that would remove primary stop tab (24) from covering the open end of dispensing tube (16) and thereby release the next available golf tee.

Figure 7:
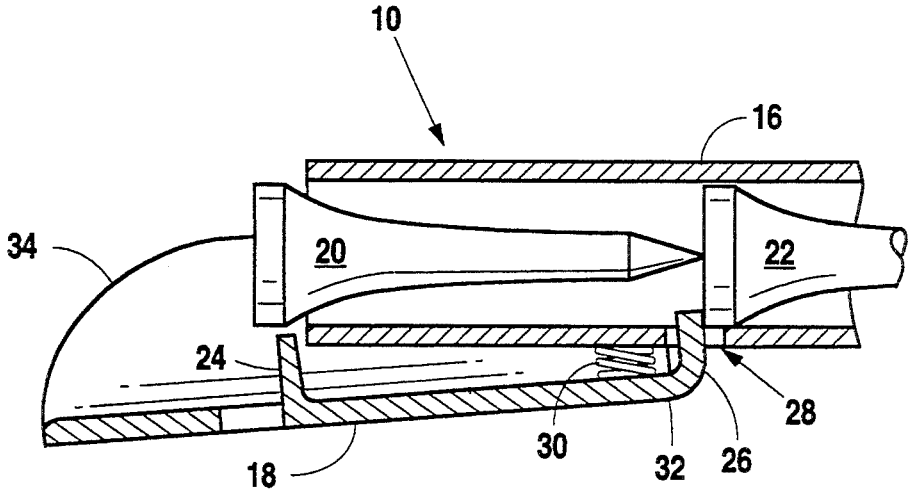
FIG. 7 is a partial cross sectional view of the dispensing end of the preferred embodiment of the present invention similar to that shown in FIG. 2, but with the dispensing mechanism in its release configuration.

Reference is now made to FIG. 7 for a detailed description of the same view as that shown in FIG. 2 with dispensing mechanism (18) pivoted and rotated in a manner that releases and dispenses a golf tee from the device. Recall first that dispensing mechanism (18) is attached to the open end of dispensing tube (16) by means of pivot indentations (50*a*) and (50*b*) (not shown) in FIG. 2 or FIG. 7, but described above with respect to FIGS. 5 and 6. These pivot indentations (50*a*) and (50*b*) allow rotation of dispensing mechanism (18) about a point approximately central to the cross sectional view of dispensing tube (16) and about half way down the length of the first tee within the dispensing mechanism. This rotation allows spring (30) to be alternately compressed or extended and allows the spring's relaxed position to be one hereinafter defined as "closed" for dispensing mechanism (18). FIG. 2, therefore, would disclose a "closed position" and FIG. 7 would disclose an "open position" for dispensing mechanism (18).

In the open position shown in FIG. 7, proximal end (34) of dispensing mechanism (18) is pushed by the user away from the opening of dispensing tube (16) thereby removing primary stop tab (24) from inhibiting the release of golf tee (20). Simultaneous with the removal of primary stop tab (24) is the insertion of secondary stop tab (26) through aperture (28) in the wall of dispensing tube (16) in a manner that prevents the next golf tee (22) from being released immediately after the release of golf tee (20). Not shown in FIG. 7, but effecting the release of golf tees (20) and (22) is the force associated with spring mechanism (38) acting on the last or lower most golf tee (36 in FIG. 3) in dispensing device (10). The force created by spring mechanism (38) is sufficient to easily direct golf tee (20) out from the open end of dispensing tube (16), but not so great as to force golf tee (22) past stop tab (26) which appropriately interrupts its travel.

The release of the proximal end (34) of dispensing mechanism (18) by the user allows spring (36) to return dispensing mechanism (18) to the closed position shown in FIG. 2, thereby momentarily releasing golf tee (22) from its position held deeper within dispensing tube (16) by secondary stop tab (26). As secondary stop tab (26) is removed from aperture (28), golf tee (22) is released forward towards the opening of dispensing tube (16) to a position previously held by golf tee (20). By this time, primary stop tab (24) has returned to partially obstruct the opening of dispensing tube (16) in a manner that prevents the complete release of golf tee (22). Golf tee dispensing device (10) is now in a condition appropriate for the release when desired, of a subsequent golf tee.

Figure 8:
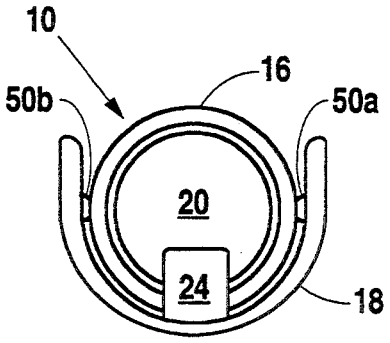
FIG. 8 is an end view of the dispensing end of the preferred embodiment of the present invention.

Reference is now made to FIG. 8 for a detailed description of an end view of dispensing device (10). Now in its closed position, i.e., that position shown in FIG. 2, dispensing mechanism (18) is shown in FIG. 8 as partially obstructing the open end of dispensing tube (16). The head of golf tee (20) is shown in its ready position within the confines of dispensing tube (16). Pivot indentations (50*a*) and (50*b*) are seen where they contact the exterior walls of dispensing tube (16) at a location where appropriate indentations (now shown) receive pivot indentations (50*a*) and (50*b*) and allow dispensing mechanism (18) to pivot in a manner that opens and closes the dispensing end. Primary stop tab (24) is shown in FIG. 8, wherein it obstructs the complete release of golf tee (20) by inhibiting the motion of the head of golf tee (20) further out of the open end of dispensing tube (16). The manner in which dispensing mechanism (18) partially encompasses dispensing tube (16) can be easily seen in FIG. 8.

Figure 9:
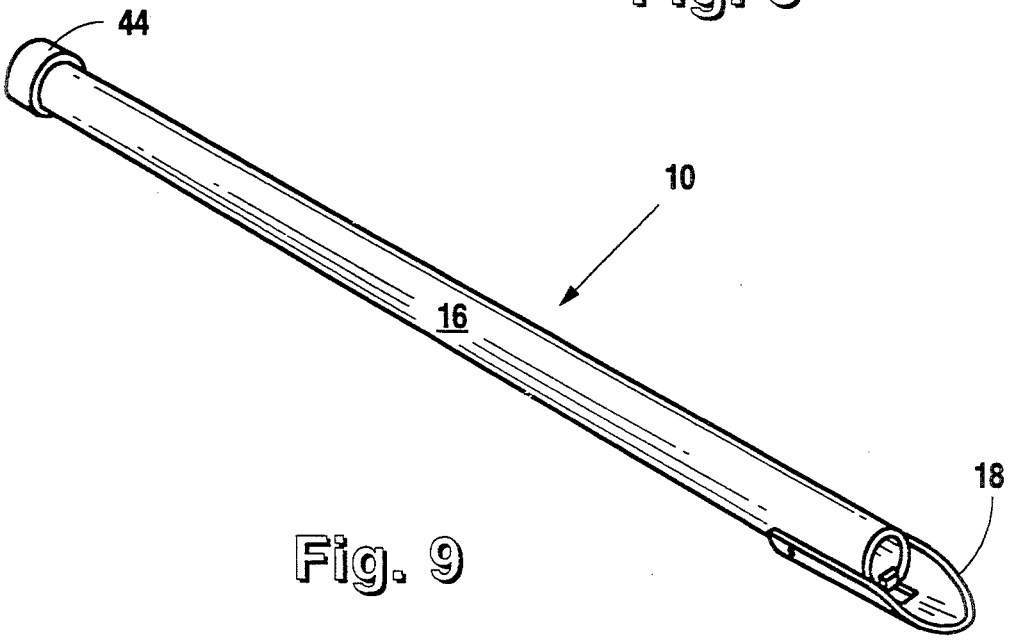
FIG. 9 is a perspective view of the preferred embodiment of the present invention.

Reference is now made to FIG. 9 for a perspective view of the preferred embodiment of the present invention shown in its entirety removed from the typical golf club bag. As indicated above, the dimensions of dispensing device (10) are such that it may easily be incorporated into a standard sized golf club bag adjacent the golf clubs held therein. Such a length of dispensing tube (16) might appropriately hold 10 to 12 golf tees for use during a round of golf. As shown in FIG. 9, dispensing mechanism (18) is positioned at one end of dispensing device (10) and cap (44) is shown at the opposite end of dispensing device (10). Dispensing tube (16) in the preferred embodiment is constructed from standard sized PVC tubing dimensioned as described above to appropriately retain standard golf tee configurations.

It is anticipated that those skilled in the art could readily modify the above described preferred embodiment so that it is capable of functioning in conjunction with non-standard sized golf tee configurations that are sometimes available. The basic principal of dispensing golf tees from a magazine type enclosure could be easily translated for other golf tee structures and sizes. Likewise, modifications to the basic design as may be appropriate for use and application in golfing equipment other than the standard sized golf club bags. It is possible, for example, that such a device contemplated by the present invention could be adhered to a hand drawn golf bag carrier, as well as motorized golf carts or golf club carriers. Any golfing structure that travels with the golfer during the play of a round of golf could be an appropriate location for attaching the dispensing device of the present invention.

It is also anticipated that such dispensing devices could be located at various points about the golf course itself in a manner that provides golf tees as a convenience to golfers as they come upon a particular point in the round of golf. The device of the present invention could, for example, be mounted to a post adjacent the tee for each or every other hole played in a round of golf. This would eliminate the necessity of the golfer retaining golf tees throughout the round of golf and would make immediately available a replacement tee should one be needed at the tee off point. These and other applications of the present invention should, therefore, be apparent from the drawings, the above specifications, and from the hereinafter appended claims.

We claim:

1. An apparatus for storing, retaining, and dispensing golf tees for use during play of the game of golf, comprising:

dispensing tube, said dispensing tube having a diameter appropriate for the passage of a standard sized golf tee easily therethrough, said dispensing tube having a length sufficient to retain at least one standard sized golf tee therein, said dispensing tube closed at a first end and open at a second end;

spring disposed within said dispensing tube, said spring having a first end in contact with said first end of dispensing tube and a second end extending through said dispensing tube towards said second end of said dispensing tube;

dispensing mechanism pivotally attached to said second end of said dispensing tube said dispensing mechanism comprising:

a first stop tab movable between a first position partially obstructing said second end of said dispensing tube and a second position clearing said second end of said dispensing tube; and a second stop tab movable between a first position, wherein said second stop tab is removed from an aperture in a wall of said dispensing tube and a second position, wherein said second stop tab projects through said aperture in said wall Of Said dispensing tube in a manner that interrupts a flow of said golf tees through said tube upon release;

wherein standard sized golf tees are insertable in said dispensing tube in a manner that said spring forces said golf tees towards said second end of said dispensing tube and in which said dispensing mechanism alternately prevents release of said golf tees and permits release of said golf tees from said dispensing tube.

2. The golf tee dispensing apparatus of claim 1, wherein said spring comprises a coiled wire spring element and a solid cylindrical spring block, wherein said spring block is located at said second end of said spring and contacts said golf tees retained in said dispensing tube.

3. The golf tee dispensing apparatus of claim 1, wherein said dispensing mechanism is configured so as to be received by the palm of a golfer and to be moved by such contact from said first position to said second position of said dispensing mechanism.

4. The golf tee dispensing apparatus of claim 1, wherein said dispensing tube has a length approximately equal to a standard sized golf club and thereby approximately equal to the depth of a standard sized golf bag.

* * * * *